US005624272A

United States Patent [19]

Ohsumi

[11] Patent Number: 5,624,272

[45] Date of Patent: Apr. 29, 1997

[54] CONNECTOR HAVING LOCKING MECHANISM

[75] Inventor: Hideki Ohsumi, Haibara-gun, Japan

[73] Assignee: Yazaki Corporation, Tokyo, Japan

[21] Appl. No.: 429,795

[22] Filed: Apr. 27, 1995

[30] Foreign Application Priority Data

May 11, 1994 [JP] Japan ..... 6-097319

[51] Int. Cl.[6] ..... H01R 13/627

[52] U.S. Cl. ..... 439/353; 439/357

[58] Field of Search ..... 439/350, 351, 439/352, 354, 355, 356, 357, 358

[56] References Cited

U.S. PATENT DOCUMENTS

| | | | |
|---|---|---|---|
| 4,986,766 | 1/1991 | Leonard et al. | 439/352 |
| 5,292,258 | 3/1994 | Sakurai | 439/353 |
| 5,399,045 | 3/1995 | Yoneda et al. | 439/352 |
| 5,417,586 | 5/1995 | Endo et al. | 439/353 |

FOREIGN PATENT DOCUMENTS 1-34846 10/1989 Japan .

*Primary Examiner*—Hien Vu

*Attorney, Agent, or Firm*—Armstrong, Westerman, Hattori, McLeland & Naughton

[57] ABSTRACT

A connector comprising a first connector housing having a resilient locking arm and side walls provided on both sides of the locking arm to protect the locking arm, and a second connector housing having a locking protrusion to engage the resilient locking arm for locking. The first connector housing has a mechanism for preventing an excessive shift of the locking arm when the resilient locking arm is unlocked from the locking protrusion. The mechanism includes an engagement member arranged on the locking arm which projects beyond the transverse sides of the locking arm and receipt members which extends from the respective side walls beneath the ends of the engagement member so as to hit thereon when said locking arm is pushed down. Thus, a mechanism for preventing an application of excessive stress to the locking arm can be provided without increasing the size of the connector housings.

3 Claims, 3 Drawing Sheets

CONNECTOR HAVING LOCKING MECHANISM

BACKGROUND OF THE INVENTION

1. Field of the Invention

The present invention relates to a connector, and more particularly, to a connector having a locking mechanism used for connection of wiring harnesses for vehicles.

2. Description of the Related Art

FIG. 6 is a perspective view of a known connector having a locking mechanism. FIG. 7 is a side view of the connector of FIG. 6, which serves for explaining the operation of the locking mechanism.

In FIGS. 6 and 7, reference symbol a denotes a male connector housing, and reference symbol b denotes a female connector housing. On the one side wall of the male connector housing a, a locking arm c is provided, and on the corresponding side wall of the female connector housing b, a locking protrusion d cooperable with the locking arm c is provided.

The locking arm c is provided as a seesaw locking mechanism which can swing about an upright supporting portion $C_1$ disposed at the intermediate portion. The locking arm c has a locking engagement portion $C_2$ at the front and an operation portion $C_3$ at the rear.

In this arrangement, when a pair of connector housings a and b are coupled with each other, the front of the locking arm c is urged upwardly along the guiding slope or cam surface $d_1$ of the locking protrusion d. When it climbs over the locking protrusion d, the locking arm c is restored to an original form by the resiliency of the upright supporting portion $C_1$ so that the locking engagement portion $C_2$ engages with the locking protrusion d.

For unlocking, the operation portion $C_3$ is pushed. Then, the locking engagement portion $C_2$ is manually raised and is released from the engagement with the locking protrusion d so that the pair of connector housings a and b are separated from each other. In this case, if excessive pushing force is applied to the operation portion $C_3$, the upright supporting portion $C_1$ may be damaged. In order to prevent this, a mechanism for preventing application of excessive stress of the locking arm consisting of a fitting portion $C_4$ and protrusion e is provided to prevent the shifting operation of the locking arm c over a predetermined limit.

The seesaw locking mechanism, as described above, has the following defect. Provision of the above mechanism for preventing application of excessive stress on the side of operation portion $C_3$ requires the concerned housing, itself, to be extended. This leads to a tendency of increasing the size of the connector housing into a large-scaled element, which is a undesirable in design of the connector.

SUMMARY OF THE INVENTION

An object of the present invention is to provide a connector having a locking mechanism which can be provided with a mechanism for preventing application of excessive stress without increasing the size of the connector housings.

In order to attain the above object, in accordance with the present invention, there is provided a connector comprising: a first connector housing having a resilient locking arm and side walls provided on both transverse sides of the locking arm to protect the locking arm; a second connector housing having a locking protrusion to be locked with the resilient locking arm; and means for preventing an excessive shift of the locking arm when the resilient locking arm is unlocked from the locking protrusion, said means being accommodated within said first connector housing.

In the operation of unlocking, when the resilient locking arm of said first connector housing is pushed down, the engagement portion at a free end of said first connector housing separates from the locking protrusion of said second connector housing, and an engagement member arranged on the resilient locking arm engages receipt members projected from the side walls so that application of excessive stress to the locking arm, i.e., excessive shift of the locking arm can be prevented.

Since the mechanism for preventing an application of excessive stress to the locking arm is accommodated within the length of the first connector housing, the resilient locking arm being pushed in order to release a pair of connector housings separated from each other will not be excessively shifted. Thus, the mechanism for preventing application of excessive stress to the locking arm can be provided without increasing the size of the connector housings.

The above and other objects and features of the present invention will be more apparent from the following description taken in conjunction with the accompanying drawings.

DESCRIPTION OF THE PREFERRED EMBODIMENTS

Figure 1:
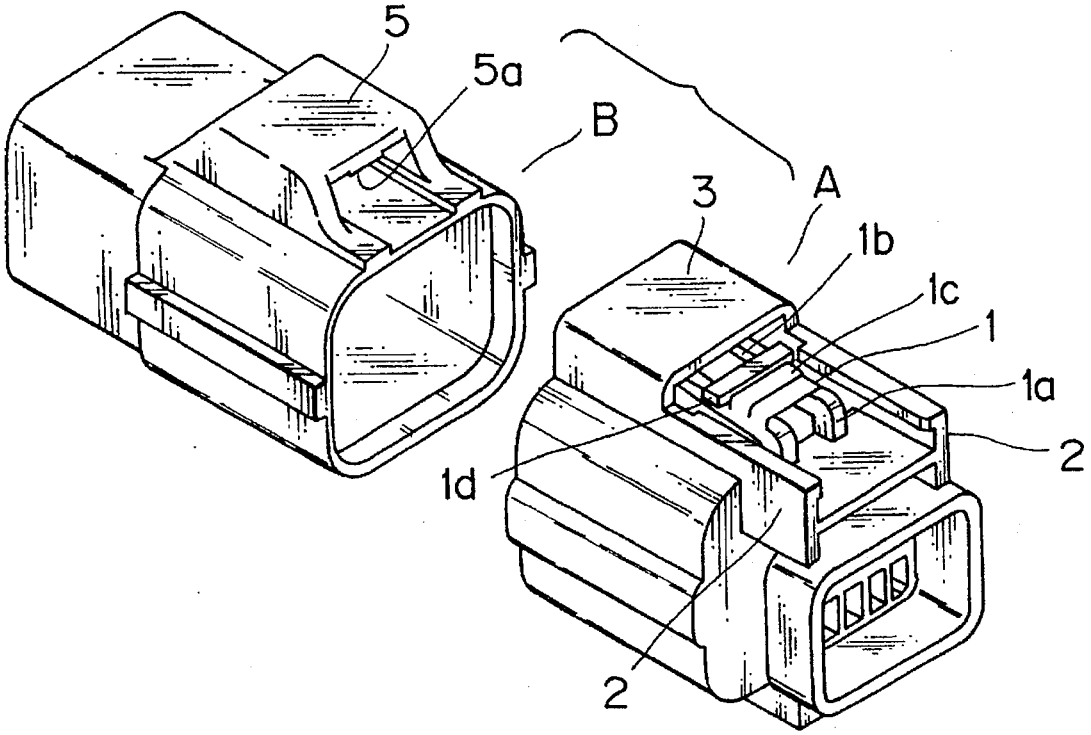
FIG. 1 is an exploded perspective view of one embodiment of the present invention.

FIG. 1 is an exploded perspective view of one embodiment of the present invention. In FIG. 1, reference symbol A denotes a male connector housing; and reference symbol B denotes a female connector housing. These connector housings are integrally formed of synthetic resin, respectively. They have a plurality of terminal chambers opposite to each other, as well known.

On an outer wall of the male connector housing A is provided a cantilever resilient locking arm 1 which is extended forward through an upright stem 1*a* at the rear end. The locking arm 1 has an engagement portion 1*b* at its front free end and a pushing operation portion 1*c* at its intermediate portion. An engagement member 1*d* for preventing application of excessive stress to the locking arm 1*a*, i.e., an excessive shift of the resilient locking arm 1, is provided so as to be projected from both transverse sides of the pushing operation portion 1*c*.

Figure 2:
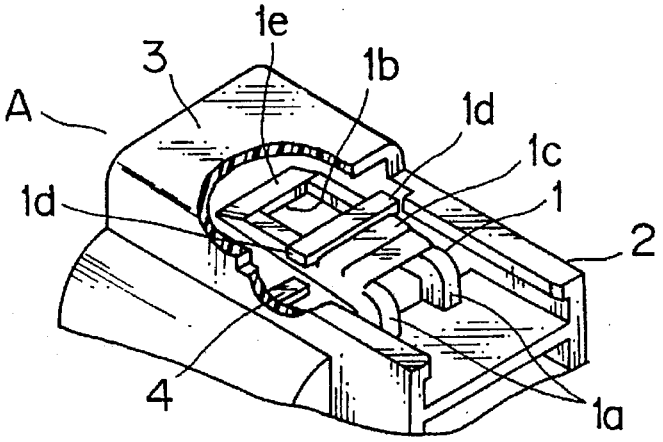
FIG. 2 is a partially broken perspective view of a male connector housing.
Figure 3:
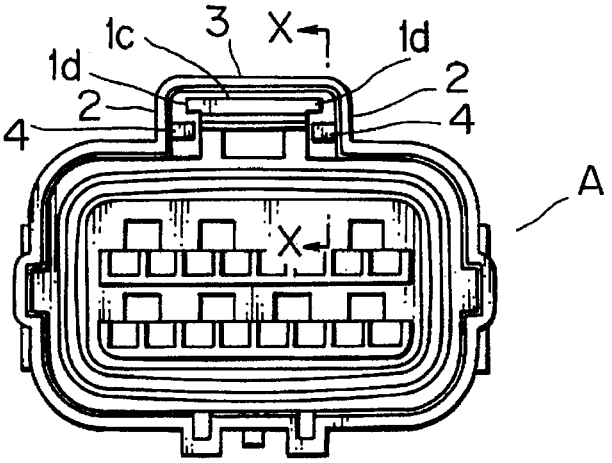
FIG. 3 is a front view of the male connector housing.
Figure 4:
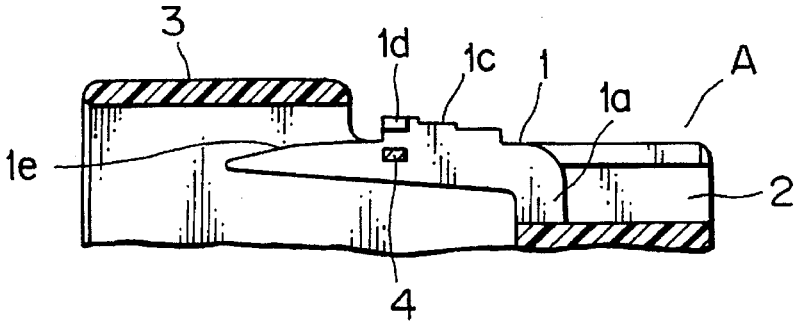
FIG. 4 is a sectional view taken along line X—X in FIG. 3.
Figure 6:
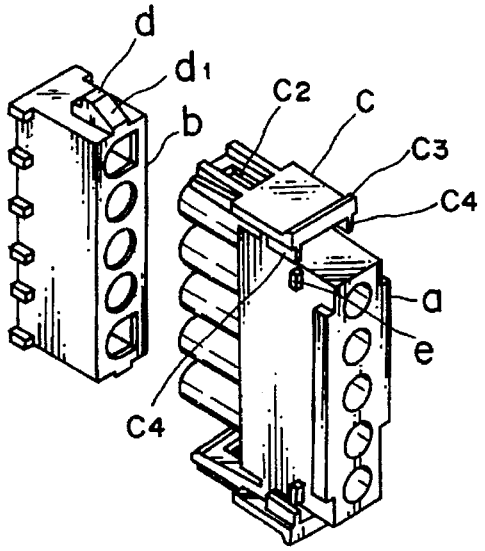
FIG. 6 PRIOR ART
FIG. 6 is a perspective view of the prior art locking mechanism.

As is clearly seen from FIG. 2, on both transverse sides of the resilient locking arm 1, a pair of walls 2 and 2 is provided for protecting the locking arm 1. The walls 2 are interconnected by a cover 3 for waterproofing that portion of the locking arm 1 which extends in front of the walls. From the inner surfaces of the protection walls 2 and 2, receipt members 4 form limit stops for preventing an excessive downward shift of the locking arm 1, together with the engagement member 1*d*. The receipt members 4 are projected from the walls 2 at lower positions opposite the engagement portion 1*d* which, at opposite ends, underlie the ends of the engagement member 1*d* . The mechanism for preventing application of excessive stress to the locking arm 1, therefore, includes the engagement member 1*d* and the receipt members 4 which cooperate with it. As seen from FIG. 1, on the outer wall of the female connector B, an engagement frame 5, into which the resilient locking arm 1 advances, is provided, and at the inlet of the engagement frame 5, a locking protrusion 5*a* is protruded towards the body of the female connector housing B.

Figure 5A:
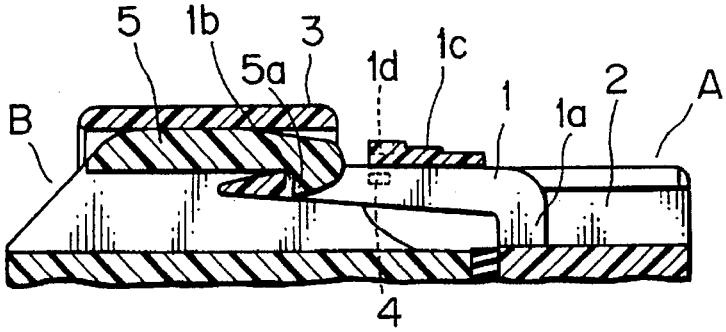
FIGS. 5A, 5B and 5C are sectional views showing the operation of the locking mechanism in an unlocking process.

When the male and female connector housings A and B are coupled to each other, the tapered abutting portion 1*e* at the front end of the resilient locking arm 1 abuts a cooperating surface of the locking protrusion 5*a* at the inlet of the engagement frame 5. As the degree of coupling or fitting increases, the resilient locking arm 1 is shifted inwardly. When the resilient locking arm 1 extends beyond the locking arm 5*a*, it rises due to its resiliency so as to be restored to the original form. Then, the engagement portion 1*b* on the locking arm 1 is engaged with the locking protrusion 5*a* on the engagement frame 5 so that the complete fitting state of the female and male connector housings A and B is established (FIG. 5A).

Figure 5B:
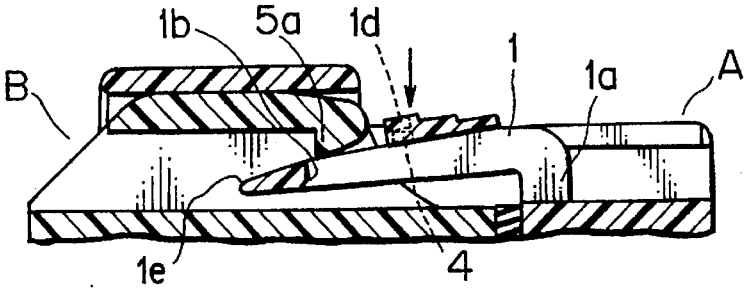
Figure 5C:
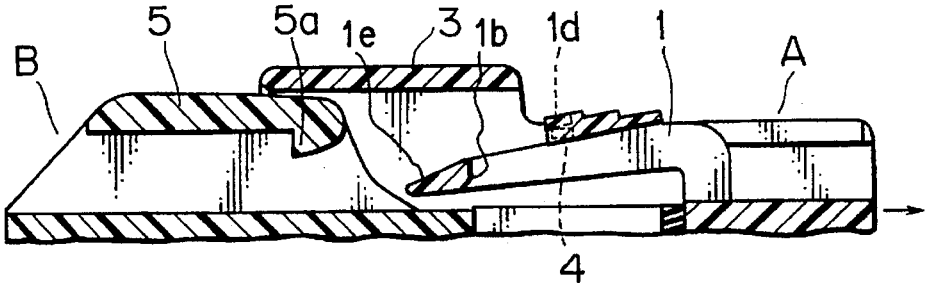
Figure 7:
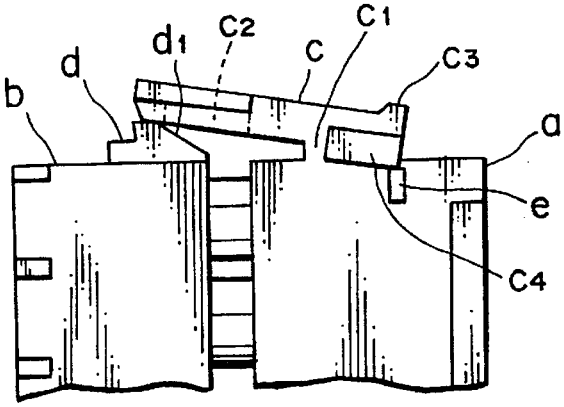
FIG. 7 PRIOR ART
FIG. 7 is a side view of the main part of the locking mechanism in FIG. 6, which serves for explaining the operation of the locking mechanism.

In unlocking, the pushing operation portion 1*c*is manually pushed down so that the resilient locking arm 1 is shifted downwardly until the engagement portion 1*b* is unlocked from the locking protrusion 5*a* (FIG. 5B). The connector housings A and B are separated from each other to release the fitting state (FIG. 5C). Then, when the resilient rocking arm 1 is shifted downwardly to a certain degree, the opposite ends of the engagement member 1*d* hits on the respective receipt members 4 so that an application of excessive stress to the resilient locking arm 1 can be prevented.

What is claimed is:

1. A connector comprising:

a first connector housing having a resilient locking arm containing an engagement portion at a free end thereof and side walls provided on said housing on both transverse sides of said locking arm to protect said locking arm;

a second connector housing having a locking protrusion for engagement with said engagement portion of said resilient locking arm; and means for preventing an excessive shift of said locking arm when the resilient locking arm is unlocked from the locking protrusion, said means for preventing an excessive shift of said locking arm including an engagement member arranged on said locking arm with ends that project beyond the opposite transverse sides of the locking arm and receipt members extending from said side walls, each of said receipt members underlying said ends of said engagement member so as to hit thereon when said locking arm is pushed down.

2. A connector according to claim 1, wherein said resilient locking arm is a cantilever arm extending forward from an upright stem positioned rearwardly of said free end.

3. A connector according to claim 1, wherein, when said engagement portion at said free end of said resilient locking arm hits on a sloping surface of said locking protrusion, it resiliently shifts downwardly along the sloping surface of said protrusion and is thereafter resiliently restored to its original disposition so as to be engaged with the locking protrusion.

* * * * *